United States Patent [19]

Hruda et al.

[11] 4,302,642

[45] Nov. 24, 1981

[54] VACUUM SWITCH ASSEMBLY

[75] Inventors: Robert M. Hruda, Horseheads; Paul O. Wayland, Montour Falls, both of N.Y.

[73] Assignee: Westinghouse Electric Corp., Pittsburgh, Pa.

[21] Appl. No.: 827,398

[22] Filed: Aug. 24, 1977

[51] Int. Cl.[3] ..... H01H 33/66

[52] U.S. Cl. ..... 200/144 B; 200/145; 200/262; 136/205; 307/112

[58] Field of Search ..... 200/144 B, 145, 262; 136/205; 307/112

[56] References Cited

U.S. PATENT DOCUMENTS

| | | | |
|---|---|---|---|
| 2,981,817 | 4/1961 | Frentzel | 200/144 B |
| 3,399,286 | 8/1968 | Kerr, Jr. | 200/144 B |
| 4,075,448 | 2/1978 | Seedorf et al. | 200/144 B |

*Primary Examiner*—Robert S. Macon
*Attorney, Agent, or Firm*—W. G. Sutcliff

[57] ABSTRACT

A vacuum switch assembly which is connectable as a shunting switch across the electrodes of an electrochemical cell, in which a plurality of electrical parallel current paths are provided through a plurality of parallel vacuum switches with separate electrical bus conductors extending from each switch contact. The vacuum switch layout is particularly adapted to permit bus conductor paths to the electrochemical cell which minimize stored induction energy which must be dissipated. The vacuum switch operating mechanism provides for approximately simultaneous switch operation with means for adjusting the individual switch openings. The switch assembly is compact and portable for correction to any one of the series cells in a plant.

7 Claims, 5 Drawing Figures

VACUUM SWITCH ASSEMBLY

BACKGROUND OF THE INVENTION

The present invention relates to vacuum switch assemblies which are used as an electrical shunting switch with electrochemical cells. An electrochemical or electrolytic cell is one in which a direct current is passed through an electrolyte containing solution between spaced electrodes, with ionic separation of the positive and negative ions taking place at the respective electrodes. The most common electrochemical cells are used to produce sodium hydroxide and chlorine from brine. The cells may be mercury cells in which mercury serves as the cathode, or the more modern diaphragm or membrane cells. A diaphragm or membrane cell has a porous member through which the electrolyte passes between the electrodes. The typical electrochemical cell manufacturing installation has many cells electrically in series, with a direct current working voltage for each cell of less than about 5 volts, and with a very high current of about 30,000 amperes or greater.

When a single series cell must be inspected or worked on for maintenance, it is necessary to shunt the cell to permit the continued operation of the other series connected cells. The electrical shunting switch must be capable of carrying and interrupting the very high currents of the system. The shunting switch must interrupt current in the shunt path when the cell is to be placed back in series with the other cells. Because of the high current a significant amount of energy must be dissipated during interruption. This causes switch contact deterioration and limits the switch life. The vacuum switch assembly of the present invention is compact and is portable or movable for connection to any one of the cells which make up an operating line.

A recent innovation has been the use of vacuum switches as a shunting switch for electrolytic cells, as described in copending applications, Ser. No. 650,322, filed Jan. 19, 1976, entitled "Low Voltage Switch"; Ser. No. 650,406, filed Jan. 19, 1976, entitled "Low Voltage Switch And Operating Mechanism"; and in U.S. Pat. No. 3,950,628, issued Apr. 13, 1976. The copending applications describe a vacuum switch assembly with a plurality of electrically paralleled switches which are approximately simultaneously operated as a shunting switch for an electrolytic cell. Such vacuum switch assemblies offer many practical operating advantages over the heretofore used air switches. The vacuum switch has a significant longer operating lifetime due to the greater energy dissipation characteristic.

Recently proposed electrolytic cells have operating currents which are significantly higher, some as high as 150 kiloamperes. While the vacuum switches and the operating mechanism described in the aforementioned copending applications provide approximately simultaneous opening of the parallel vacuum switches, it is really not possible with an electromechanical system to have the contacts part at the exact same instant in the context of of milliseconds, which is the time scale for arc interruption. The last switch contacts that part or open will be carrying the total current in the shunt and could be subject to gross contact erosion. It would be highly desirable to reduce the energy which must be dissipated by the last switch to open.

It has been the practice to use a single large bus conductor between the cell electrodes and the shunting switch contacts because of the high current it must carry.

Variation in the vacuum switch size and geometry offers some capability for operating at higher current ratings, but this is limited because the arc which forms during interruption occurs over a small local area of the contact.

The vacuum switch operating mechanism described in the copending applications did not permit adjustment of the operating mechanism travel to facilitate easy adjustment of switch openings to ensure that they were approximately simultaneous.

SUMMARY OF THE INVENTION

A vacuum switch assembly has been provided which minimizes the energy which must be dissipated by the last-to-open switch contacts. The assembly is connectable as a shunting switch across the electrodes of an electrolytic cell. A plurality of vacuum switches are disposed electrically in parallel with separate electrical bus conductors extending from each switch contact in electrical parallel, but isolated relationship, from each side of each switch to the respective cell electrodes. One side or contact of each switch is connected to a common operating mechanism which includes reciprocating links connected to respective switches for approximately simultaneously opening and closing the switch contacts.

DESCRIPTION OF THE PREFERRED EMBODIMENT

Figure 1:
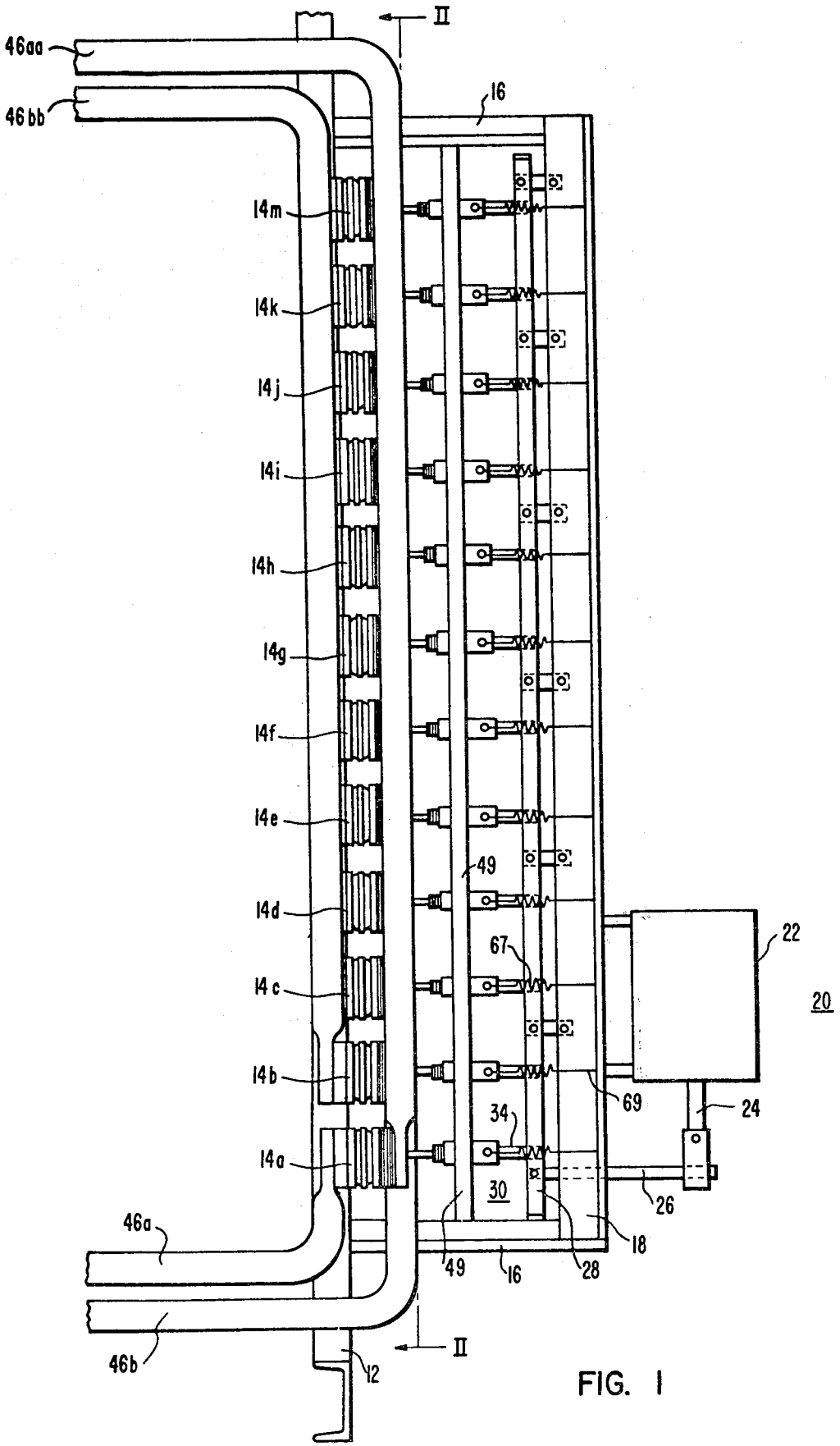
FIG. 1 is a plan view of the vacuum switch assembly of the present invention.

The invention can be best understood by reference to the exemplary embodiment shown in the drawings. In FIG. 1, the vacuum switch assembly 10 includes a base support member 12 upon which a plurality of vacuum switches 14*a*–14*m* are mounted. Support arms 16 extend from the ends of support member 12, with an operating mechanism support member 18 extending between the support arms 16. The support members 12, 16 and 18 form a relatively rigid frame support system.

A common switch actuating mechanism 20 is mounted on support member 18, and comprises an air cylinder 22, the reciprocating rod 24 of which is connected via a connecting link 26 to a common connecting link 28, which is in turn connected to the individual reciprocating operating mechanisms 30 associated with each vacuum switch 14*a*.

Each of the plurality of vacuum switches 14*a*–14*m* and operating mechanisms 30 are preferably electrically insulated from the frame support. An insulating plate is preferably provided between each switch 14 and the base support member 12 upon which it is mounted although not shown in these drawings. An insulating link 34 is connected between the common connecting link 28 and the remainder of the reciprocating operating mechanism 30 as will be explained later in detail with reference to FIG. 4.

The vacuum switch 14*a* is described in greater detail in aforementioned copending application Ser. No. 650,322. In general, vacuum switch 14*a* seen best in FIG. 4, has a hermetically sealed evacuated body defined by flexible corrugated diaphragm members 35 sealed to an insulating ring spacer 36, and to reciprocating conductive contact supports 38. The inwardly extending ends of the conductive contact supports 38 disposed within the hermetically sealed body can serve as the switch contacts, or a separate contact can be mounted on the end of the contact supports 38. The switch 14*a* is a normally closed switch with the contacts being biased together as a result of atmospheric pressure upon the flexible corrugated diaphragm members 35 due to the evacuated nature of the switch. Conductor plates 40 are connected to the outward extending ends of the contact supports 38 to facilitate electrical connection to bus connectors 42*a* and 44*b* as can be more clearly seen in FIGS. 2–4. The bus connectors 42*a*–42*m* and 44*a*–44*m* are associated with each switch 14*a*–14*m* and extend from the opposed conductor plates in opposite directions for each successive switch. The bus connector 42*a* is an elongated solid, rigid copper plate member, while bus connector 44*a* is a flexible member formed by bonding together a plurality of thin copper sheets. It is the flexibility of this bus connector 44*a* which permits reciprocating movement of the contact supports 38 to permit opening and closing of the switch.

Figure 2:
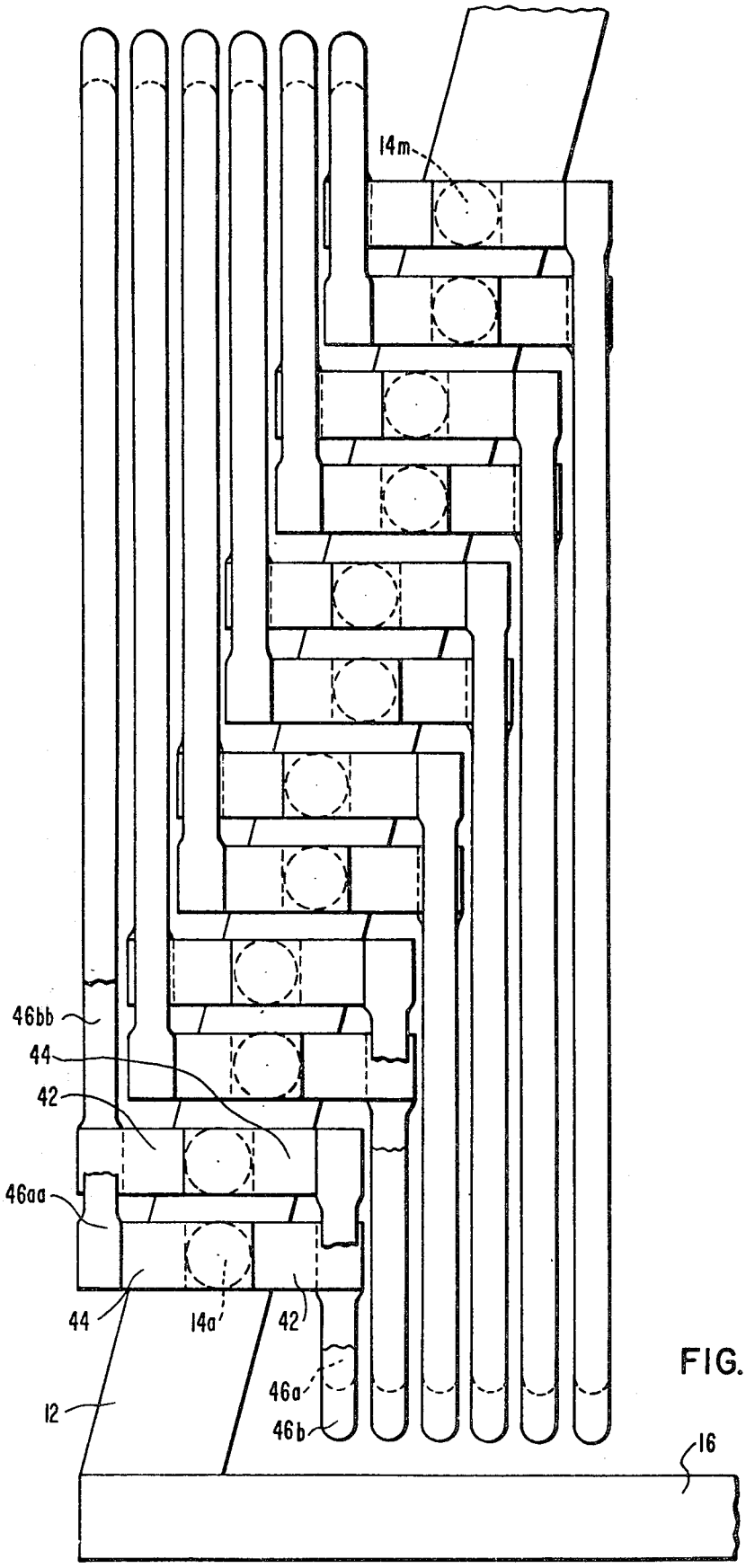
FIG. 2 is a side elevation view taken in the direction of the line II—II seen in FIG. 1.
Figure 5:
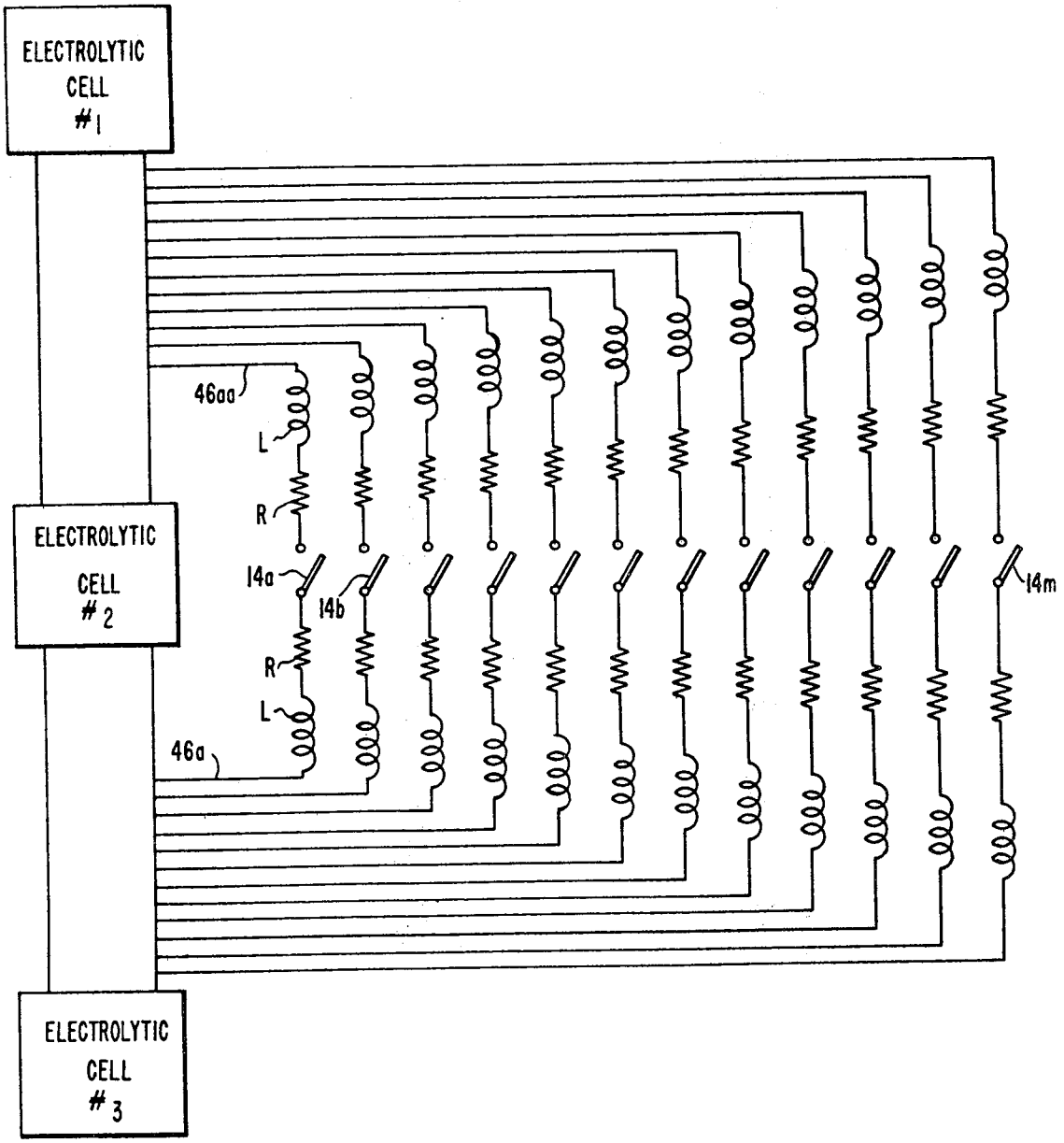
FIG. 5 is a schematic illustration of the electrical system of the present invention.

As best seen in FIG. 2, the vacuum switches 14*a*–14*m* are mounted on the base support member 12 as aligned pairs of switches. The base support member 12 is angled relative to the horizontal and the support arms 16, so that each successive pair of aligned vacuum switches is aligned along a plane parallel to but spaced from the preceding aligned pair. In this embodiment, six aligned switch pairs are seen with the angled base support member 12 facilitating offsetting of the switch pairs. Switches 14*a* and 14*b* are aligned as are succeeding pairs. Bus conductors 46*a*–46*m* and 46*aa*–46*mm* extend from each switch end to the opposed electrolytic cell electrodes and provide a plurality of separate parallel current carrying paths from the cell electrodes with bus conductors 46*a* and 46*aa* connected to the switch 14*a*. It has been found that by subdividing the shunting switch into these electrically parallel insulated circuit paths as illustrated in FIG. 5, that the current per contact can be reduced by the dividing factor, here in this embodiment the current is divided by twelve (12), and that this can be done without a significant inductance increase for the switch assembly. This permits a significant reduction in the energy which must be dissipated in the last contact to open. In FIG. 5, each of the bus conductors is illustrated as including a resistance R and an inductance L.

By way of example, a typical electrolytic cell switch hook-up with a single solid bus conductor extending from each cell electrode to the parallel switches, might have a 4 microhenry lead inductance. At a plant load of 75 kiloamperes, there will be $\frac{1}{2}$ $LI^2$, or 11,250 joules, stored energy in the leads which must be dissipated in the vacuum switches when the contacts open, and this must be dissipated in the last-to-open switch. Just by dividing the bus conductors into two closely spaced but separate circuit paths the inductance would only increase from 4 to 4.4 microhenry per circuit path, but the current is decreased by a factor of two per circuit path, so that the stored energy per path is $\frac{1}{2}$ (4.4) $(37.5)^2$, or 3100 joules per circuit path, which is less than half the stored energy of 11,250 joules for a single bus conductor set-up. The two separate circuit paths behave independently and allow more or less equal and reduced wear on each contact. There is no need to increase the amount of copper conductor, but merely to provide separate isolated conductors. For the embodiment shown in the drawings, the current in each path will be only 1/12 of the total current, and to optimize the reduction in stored energy in each path the mutual and self-induction of the bus conductors has been minimized. The aligned switch pair arrangement and bus conductor layout of the present invention minimizes mutual and self-induction for the separate circuit paths.

The provision of separate electrically parallel isolated bus conductors from each side of the switches to the electrolytic cell determines that the current which the last switch to open will have to interrupt will be significantly reduced from the maximum current value. This will be so even if the switches open out of synchronism. The effect of opening a single switch is to increase the total system resistance, and for sequential switch openings the effect is to sequentially increase the system resistance.

It can be shown that for the last switch to open the current is:

$$I\,(\text{switch}) = \frac{\text{Cell Battery Voltage} + IR\ (\text{cell})\ \text{Voltage}}{R(\text{bus}) + R(\text{switch}) + R(\text{cell})}$$

and that for a given switch and cell resistance, an increase in the bus resistance will reduce the switch current. A typical bus conductor resistance might be about 4.5 micro-ohms, and thus the total bus conductor resistance for a single switch path about 9 micro-ohms. The bus conductor resistance can be easily varied to achieve the greatest reduction in current through the last-to-open switch. However, the bus resistance must not be so high that it is not possible to shunt current from the electrolytic cell. The voltage across the switches must be less than the cell battery voltage with all the switches closed. The cell battery voltage or electrolyzing potential refers to the potential across the cell at which current begins to flow through the cell.

It is generally desirable to have the resistance of each parallel circuit path be approximately equal, so that the chance of a given switch of the assembly being the last to open each time is reduced to a low probability. This will insure relatively even wear and switch lifetimes. It is also possible to insert separate resistors in series with the bus conductors to control and determine the path resistance.

Figure 3:
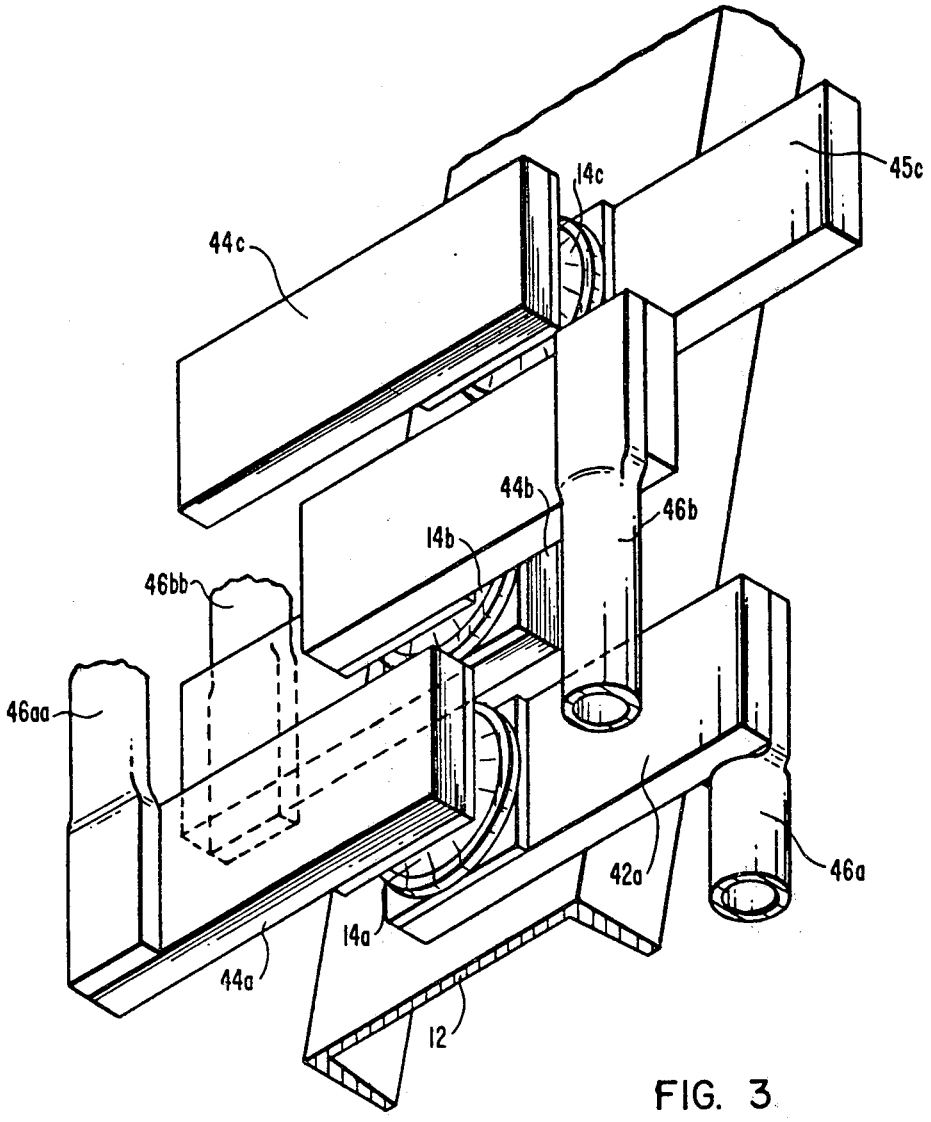
FIG. 3 is a partial perspective view of part of the switch assembly of FIG. 1.

As can be best seen in FIGS. 2 and 3, the flexible bus connector 44*a* extends upward from the first switch 14*a* at the left side of the support member 12, and the rigid bus connector 42*a* extends downward from the other side of the switch 14*a*. For each successive switch this is alternated, with the next switch 14*b* having the flexible bus connector 44*b* extending down and the rigid bus connector 42*b* extending upward. This permits a balancing of forces resulting from the reciprocating operating mechanisms.

The bus connectors 42*a* and 44*a* from each switch are connected to bus conductors 46*a*, which are preferably copper tube or pipe with a flattened end portion fitted for bolt connection to the bus connector. The paired switch set-up and the bus connector arrangement permits very close bus conductor arrangement. The bus conductors going to one side of the switches are arranged in two vertical stacks with the bus conductors for the paired switches being in a common horizontal plane. As seen in FIGS. 1 and 2, the bus conductor 46*a* extends from the cell electrode connection point and is connected to the first vacuum switch 14*a*, while bus conductor 46*b* is closely spaced from conductor 46*a* in a common horizontal plane but is connected to switch 14*b*. Each successive pair of bus conductors is connected to each successive pair of switches in like manner, and the same bus conductor arrangement is provided from the other side of the switches to the other cell electrode. In this way twelve separate, electrically parallel, isolated circuit paths are provided from cell electrode to cell electrode with individual vacuum switches provided in each circuit path. The bus conductor paths are kept to a minimum and the spacing is such to minimize inductance while maintaining electrical path isolation.

Figure 4:
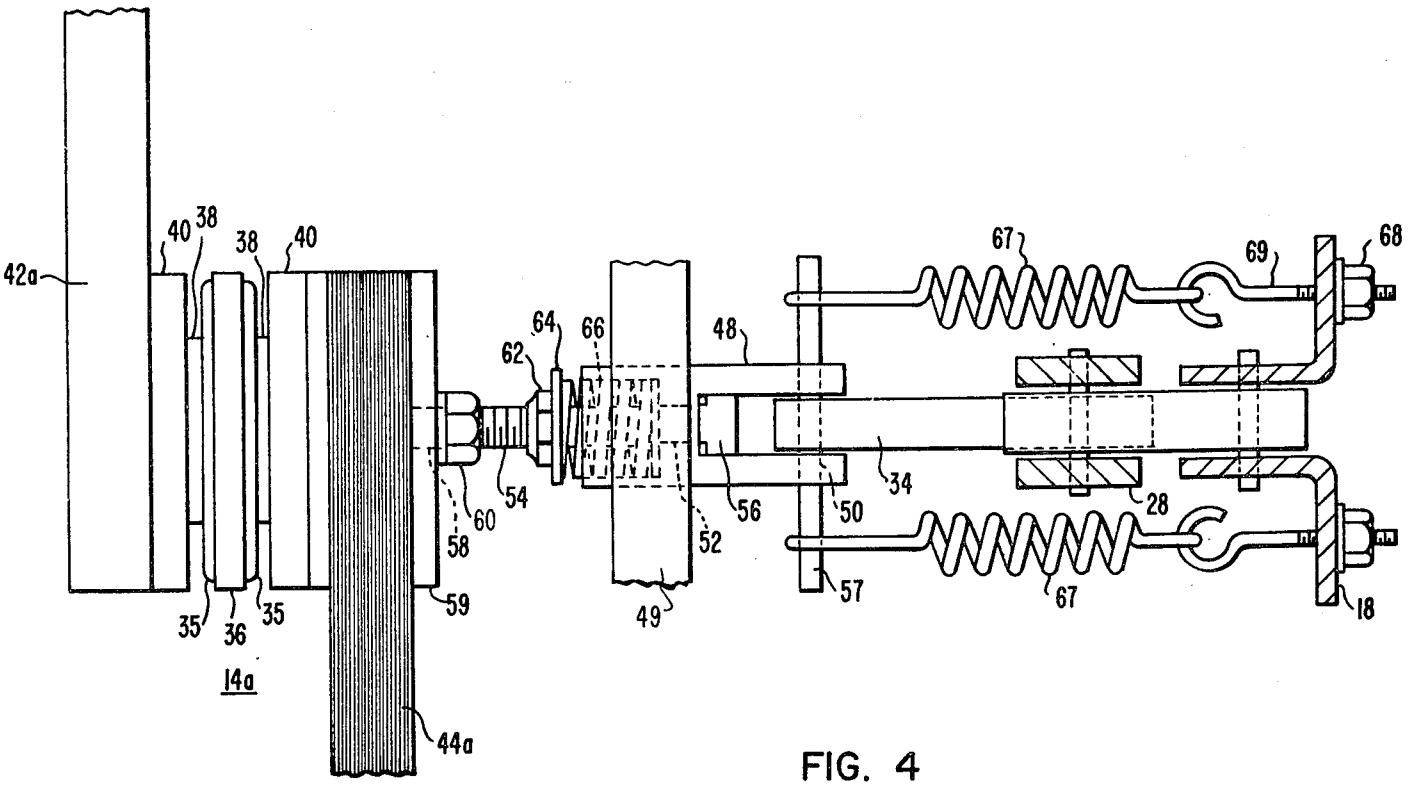
FIG. 4 is an enlarged side elevation partly in section of one switch and a portion of operating mechanism for this switch for the preferred embodiment.

The reciprocating operating mechanism 30 is seen in greater detail in FIG. 4. The insulating link 34 is connected to a connecting link 48 which is by way of example, a generally tubular member with insulating link 34 connected to the one end of link 48 via aperture 50 provided through opposed side walls with rod 57 extending through aperture 50. Connecting link 48 is supported by guide means 49 mounted on supports 16, which permits link 48 to reciprocate. An internal collar 52 is provided within the generally tubular connecting link 48. A connecting member 54 such as a bolt with an enlarged head 56, extends through the collar 52 toward the switch 14*a*, with the enlarged head 56 being of sufficient area to engage or seat on one side of the collar 52 when the link 48 is reciprocated away from the switch 14*a*. The bolt connecting member 54 is threaded into a mating aperture 58 provided in connecting plate 59 which is bolted to the bus connector 44*a* and to one side of the switch 14*a*. The bolt 54 can be adjustably threaded into the mating threaded aperture 58 to vary the position of the bolt head 56 and the travel of the reciprocating tubular member before it engages head 56 to urge the switch contacts apart to the open switch position. A locking nut 60 permits locking the bolt 54 in a fixed position after adjustment of the switch opening travel requirement. Another locking nut 62, washer 64 and spring bias means 66 are disposed on bolt 54, with spring bias means 66 fitting within the end of tubular link 48 against the collar 52, to serve as a biasing means to increase the force holding the switch contacts in the closed position.

The operating mechanism 30 is thus readily adjustable to ensure that there is approximate simultaneous opening of the plurality of vacuum switches of the assembly.

A spring 67 extends from each end of rod 51 to support member 18, and is connected thereto by insulated bushings 68 and adjustable connectors 69. These springs 67 provide the force to overcome the atmospheric force on the switches and to reciprocally move the link 48 and urge the switch contacts apart to the open position. It should be noted that since springs 67 are attached between rod 51 and the rigid support frame, the added contact force spring 66 is still effective when the switch is in the closed position.

The operation of actuating means 20, and reciprocation of rod 24 causes lateral reciprocal movement of common link 28 via link 26. The individual insulating links 34 move in a pivotal fashion, pivoting at the rod 51. The link 34 when in the vertical position keeps the switch closed. When link 34 pivots or rocks to an angle with the vertical, the springs 67 act to reciprocate upward the tubular link 48 and the switch contacts are pulled apart and the switch opened.

In summary, the provision of a vacuum switch assembly with a plurality of electrically parallel current paths for use with an electrolytic cell offers significant operating advantages. The inductively stored energy which must be dissipated in the last-to-open switch, can be significantly reduced. Also, the resistance of the switch assembly system increases as the individual paralleled switches are opened to reduce the current through the remaining closed switches, and to minimize the current flowing in the last-to-open switch.

We claim:

1. In a direct current shunting switch assembly in which a plurality of vacuum switches are disposed electrically in parallel and adapted to be connected across the electrode terminals of an electrochemical cell, the improvement wherein each vacuum switch is connected independently to separate electrical bus conductors, wherein separate electrical bus conductors extend in electrical parallel bus isolated relationship from each other from the respective vacuum switches to the cell electrode terminal connections, which electrically parallel separate bus conductors extend in closely spaced parallel path relationship to provide minimum self-inductance and mutual inductance effects, so that the energy which is dissipated in the last-to-open vacuum switch during interruption will be minimized, and the resistance value of the separate bus conductors is determined so that the potential across the switch assembly and bus conductors at the electrolytic cell electrode terminals is less than the cell battery potential when the switches are closed to permit shunting of the cell current through the plural parallel paths of the switch assembly, and the resistance value of the separate bus conductors is such that when the switches are opened to divert current back through the electrolytic cell, the current through the last-to-open switch is reduced to a value which can be interrupted without damaging the last-to-open switch.

2. The direct current shunting switch assembly set forth in claim 1, wherein the vacuum switches are disposed as a plurality of aligned switch pairs, with adjacent switch pairs being aligned along lines spaced from but parallel to the adjacent aligned pair to permit closely spaced parallel path bus connections of minimum self-inductance and mutual inductance.

3. The direct current shunting switch assembly set forth in claim 1, wherein one side of each vacuum switch is connected to a common operating mechanism including individual reciprocating links connected between the common operating mechanism and the vacuum switch for approximately simultaneous switch opening and closing, with the other sides of the vacuum switches supported on a rigid common support frame, so that reciprocation of the links effects switch opening and closing.

4. The direct current shunting switch assembly set forth in claim 1, wherein the bus conductors are tubular copper members through which a cooling fluid is passed.

5. The direct current shunting switch assembly set forth in claim 1, wherein the resistance of each bus conductor is approximately equal.

6. The direct current shunting switch assembly set forth in claim 1, wherein the separate electrical bus conductors extend from opposed ends of each switch in opposed directions, and wherein one of the bus conductors from each switch includes a flexible portion.

7. The direct current shunting switch assembly set forth in claim 6, wherein the flexible portion of the bus conductor extends from the switch in a direction normal to the reciprocating link travel direction to permit flexing in the direction of link travel.

* * * * *